US011192392B2

(12) United States Patent
Blanco Gabella

(10) Patent No.: US 11,192,392 B2
(45) Date of Patent: Dec. 7, 2021

(54) MEDIA CUTTING DEVICE AND METHOD WITH CONTACT-FREE COUPLING OF UPPER AND LOWER MEMBERS

(71) Applicant: HEWLETT-PACKARD DEVELOPMENT COMPANY, L.P., Spring, TX (US)

(72) Inventor: Jaime Abel Blanco Gabella, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/498,615

(22) PCT Filed: Jan. 30, 2018

(86) PCT No.: PCT/US2018/015867

§ 371 (c)(1),
(2) Date: Sep. 27, 2019

(87) PCT Pub. No.: WO2019/151977

PCT Pub. Date: Aug. 8, 2019

(65) Prior Publication Data

US 2021/0107303 A1 Apr. 15, 2021

(51) Int. Cl.

| | |
|---|---|
| ***B41J 11/68*** | (2006.01) |
| ***B41J 11/70*** | (2006.01) |
| *B41J 11/66* | (2006.01) |

(52) U.S. Cl.

CPC ..... *B41J 11/68* (2013.01); *B41J 11/70* (2013.01); *B41J 11/663* (2013.01); *B41J 11/703* (2013.01); *B41J 11/706* (2013.01)

(58) Field of Classification Search

CPC . B41J 11/706; B41J 11/70; B41J 11/68; B41J 11/703; B41J 11/663; B41J 11/66

See application file for complete search history.

(56) References Cited

U.S. PATENT DOCUMENTS

| | | | | |
|---|---|---|---|---|
| 5,197,198 | A | 3/1993 | Onozato | |
| 5,937,722 | A * | 8/1999 | Albright | B26D 7/2635 83/498 |
| 6,308,602 | B1 | 10/2001 | Gerber | |
| 9,452,624 | B2 | 9/2016 | Ipponyari et al. | |
| 2010/0193113 | A1 | 8/2010 | Terao | |
| 2012/0297945 | A1 * | 11/2012 | Cordero | B26D 1/245 83/56 |
| 2014/0352514 | A1 | 12/2014 | Broeker | |

FOREIGN PATENT DOCUMENTS

| | | | | |
|---|---|---|---|---|
| JP | 4644913 B2 | | 3/2011 | |
| SU | 862109 | * | 9/1981 | G03G 15/00 |
| WO | WO2011146272 | | 11/2011 | |

* cited by examiner

*Primary Examiner* — Henok D Legesse
(74) *Attorney, Agent, or Firm* — HP Inc. Patent Department

(57) ABSTRACT

A cutting device comprises an upper support and a lower support arranged above and below a media plane, and a contact-free coupling device to engage and disengage the upper support and the lower support, wherein one of the upper support and the lower support is a master support and the other one of the upper and lower supports is a slave support, and further comprises a master cutting blade arranged in the master support, wherein when the upper and lower supports are engaged, the slave support follows movement of the master support.

20 Claims, 10 Drawing Sheets

MEDIA CUTTING DEVICE AND METHOD WITH CONTACT-FREE COUPLING OF UPPER AND LOWER MEMBERS

BACKGROUND

Some printers include a cutting device which can cut a print medium before, during or after a printing operation. The cutting device may include a cutting blade supported on a carriage to move across a print zone. By movement of the carriage across the print zone and/or movement of the print medium along a media advance path through the print zone, the cutting blade may cut in one or two linear directions, such as the X and Y directions.

BRIEF DESCRIPTION OF DRAWINGS

The following description references the drawings, wherein.

DETAILED DESCRIPTION

Figure 1:
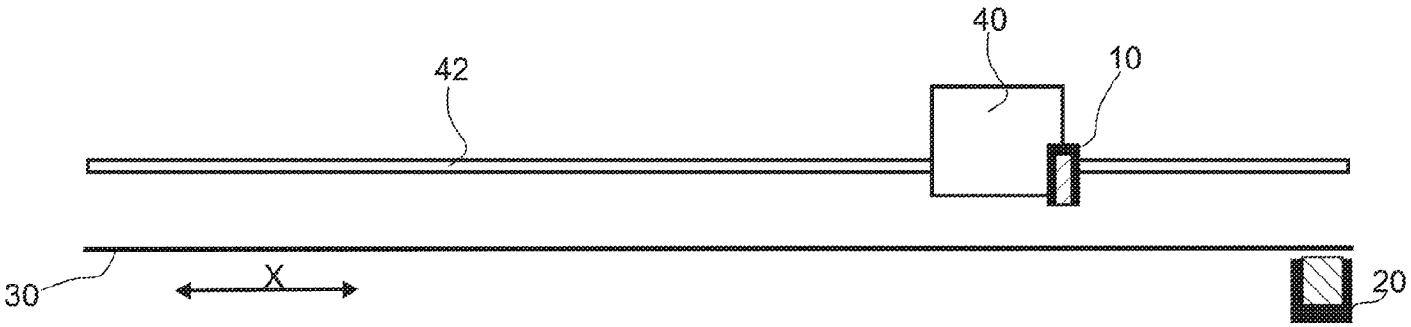
FIG. 1 is a block diagram schematically illustrating a cutting device according to an example, in a side view thereof.
Figure 2:
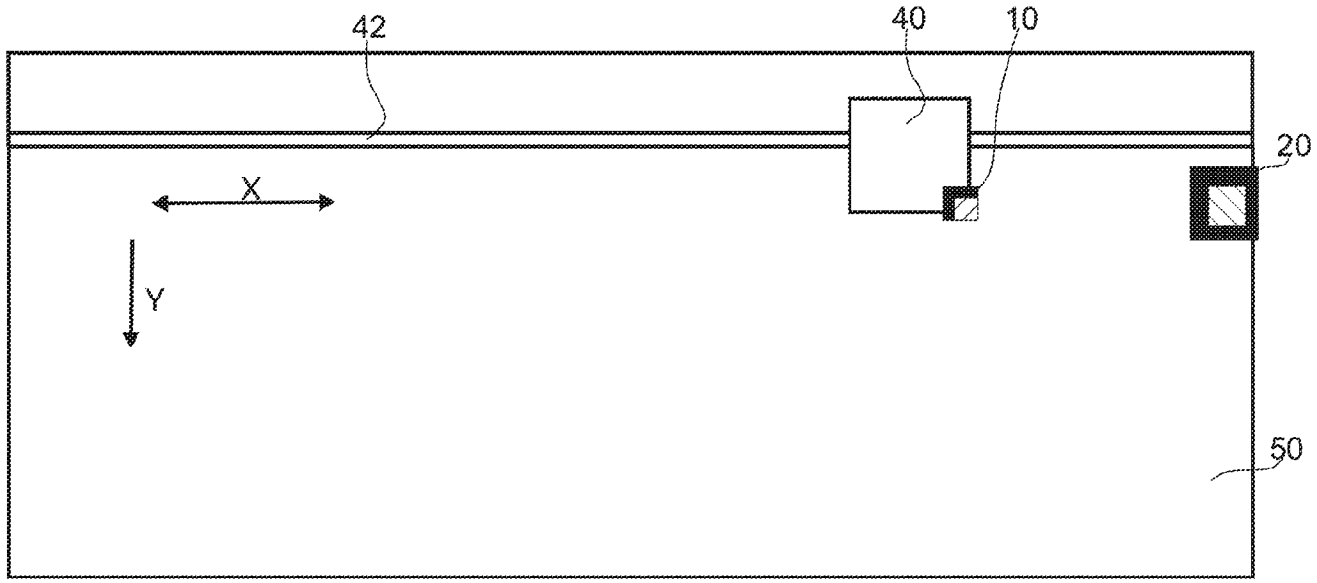
FIG. 2 is a block diagram schematically illustrating a cutting device according to an example, in a top view thereof.

FIG. 1 and FIG. 2 are block diagrams schematically illustrating a cutting device according to an example, in a side view and in a top view thereof.

In the example of FIGS. 1 and 2, the cutting device comprises an upper support 10 and a lower support 20 which respectively are located above and below a media plane 30. The upper support 10 can be arranged at a carriage 40 which is movable along a slide bar 42, in a scanning direction, also designated as X direction. The lower support 20 can be arranged at a base station (not shown in FIGS. 1 and 2) at the side of and below a cutting zone, as described below. The upper and lower supports 10, 20 are respective parts of upper and lower halves of the cutting device.

A medium 50 can be located in the media plane 30 and can advance below the upper support 10 and the carriage 40 in a media advance direction, also designated as Y direction.

A contact-free coupling device can be provided at the upper and lower supports 10, 20 to engage and disengage the upper support and the lower support. As explained in further detail below, the upper support 10 can be considered a master support and the lower support 20 can be considered a slave support wherein, when the upper and lower supports are engaged, the lower/slave support 20 follows movement of the upper/master support 10. In a variant, the upper support could be a slave support and the lower support could be a master support so that, when the upper and lower supports are engaged, the upper/slave support follows the lower/master support. As explained with reference to the following drawings, the cutting device further comprises a master cutting blade arranged in the master support. In this example, the master cutting blade is an upper cutting blade arranged in the upper support 10. In a variant, the master cutting blade could be a lower cutting blade arranged in the lower support.

In an example, the cutting device can be provided in a printer and the carriage 40 can be a printer carriage carrying print heads (not shown) and the upper support 20. The printer may, for example, be a large format inkjet printer. In this example, the cutting zone can correspond to, overlap with or be adjacent to a print zone, and the scanning direction X can correspond to a printing direction X of print heads located in the carriage 40. The medium 50 located in the media plane 30 can be a print medium, such as a single sheet or a continuous web of print medium fed to the print zone from an input tray, a drawer or roll of paper, for example. The medium may be paper or a foil, for example.

In this example, the upper cutting blade and upper support are attached to and move with the printer carriage 40 so that the cutting blade can move in the X direction. Additionally, as explained below, the cutting blade can be pivoted to adjust a cutting direction relative to the medium.

The upper support 10 can be coupled with the lower support 20 via a contact-free coupling device, with the medium sandwiched there between. When the contact free coupling device is activated, the upper support 10 can engage with the lower support 20 or can "pick up" the lower support 20 and can "drag" the lower support 10 to a cutting position and along a cutting line, with the medium still sandwiched there between.

Figure 12:
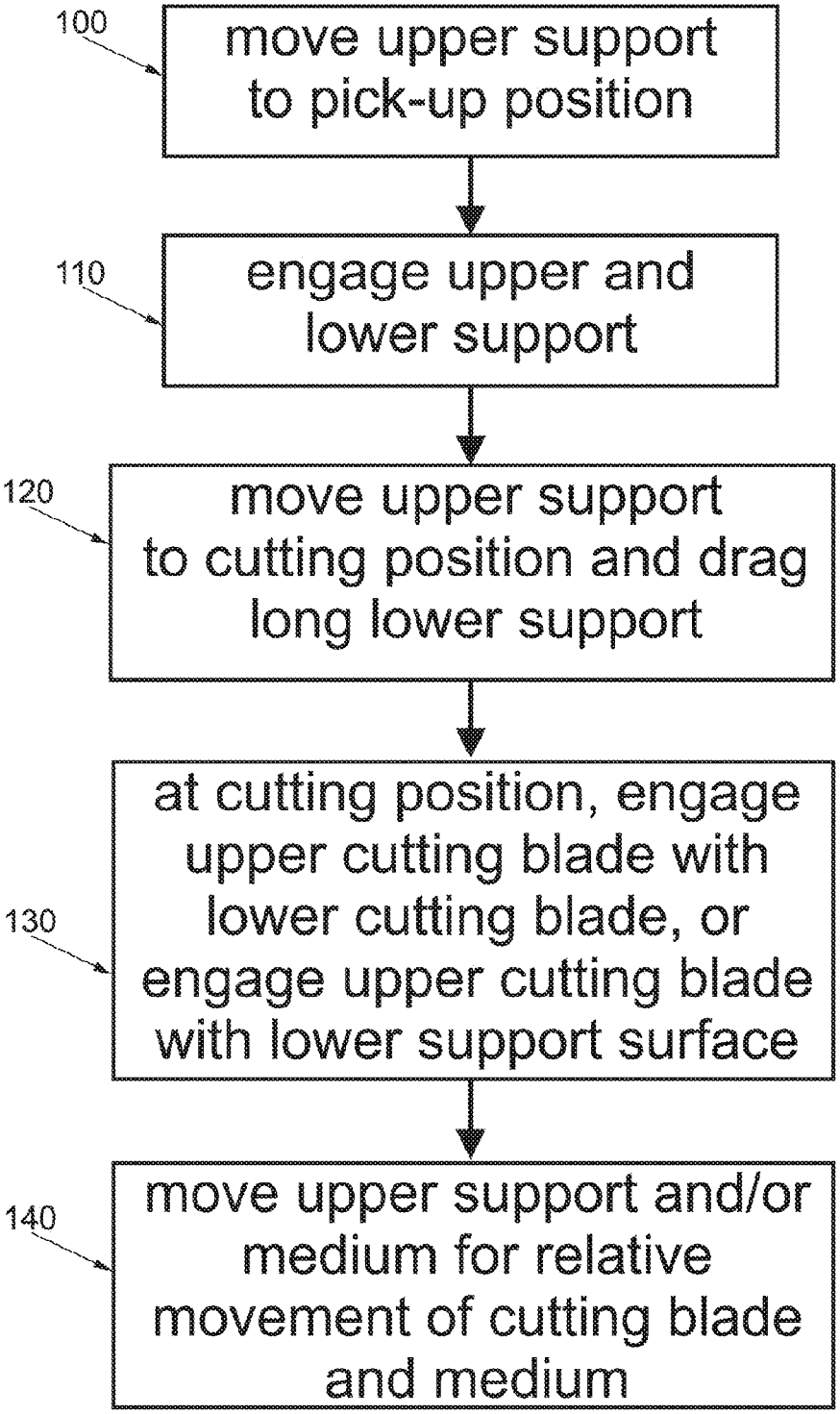
FIG. 12 is a flow diagram of a media cutting method according to an example.

In one example of a cutting sequence, illustrated in FIG. 12, the upper support 10 is moved to a pick-up position where the lower support 20 is stored, at 100. This pick up position can be at the side of the print zone, below a position over which the medium passes, as schematically illustrated in FIG. 1. The upper and lower supports 10, 20 can be engaged via the contact free coupling device, at 110, and the upper support 10 can be moved to a cutting position, at 120. The upper support 10 can be moved by moving the carriage 40, for example. Additionally, the medium 50 can be moved below the carriage 40 to eventually position the upper support 10 relative to the medium 50 in the X and Y directions. Because the lower and upper supports are engaged, the lower support 20 will follow the movement of the upper support 10. When at the cutting position, the upper cutting blade arranged in the upper support 10 can be engaged with a lower cutting blade or with a lower support surface provided in the lower support 20, at 130. The upper support 10 then is moved relatively to the medium 50, e.g. by moving the carriage and/or the medium, with the lower support 20 following the movement of the upper support 10, at 140. Accordingly, the media is cut between the upper cutting blade and the lower cutting blade or lower support surface.

In an example, the contact free coupling device comprises at least one magnet. For example, an electromagnet can be provided on the upper support, with a corresponding magnet or ferromagnetic element at the lower support, forming a magnet pair, with media to be cut sandwiched between the magnet pair. When the magnet pair is activated the upper support can pick up the lower support and can guide the lower support to the cutting position. A further magnet pair may be provided to engage the upper and lower cutting blades or the upper cutting blade and the lower support surface by moving them towards each other through magnetic force. The further magnet also can make the lower cutting blade follow any rotational movement of the upper cutting blade. Accordingly, the magnet pairs can make the lower support follow any movement of the upper support and upper cutting blade to cut the medium. To release the lower support, the magnets are deactivated.

Figure 3:
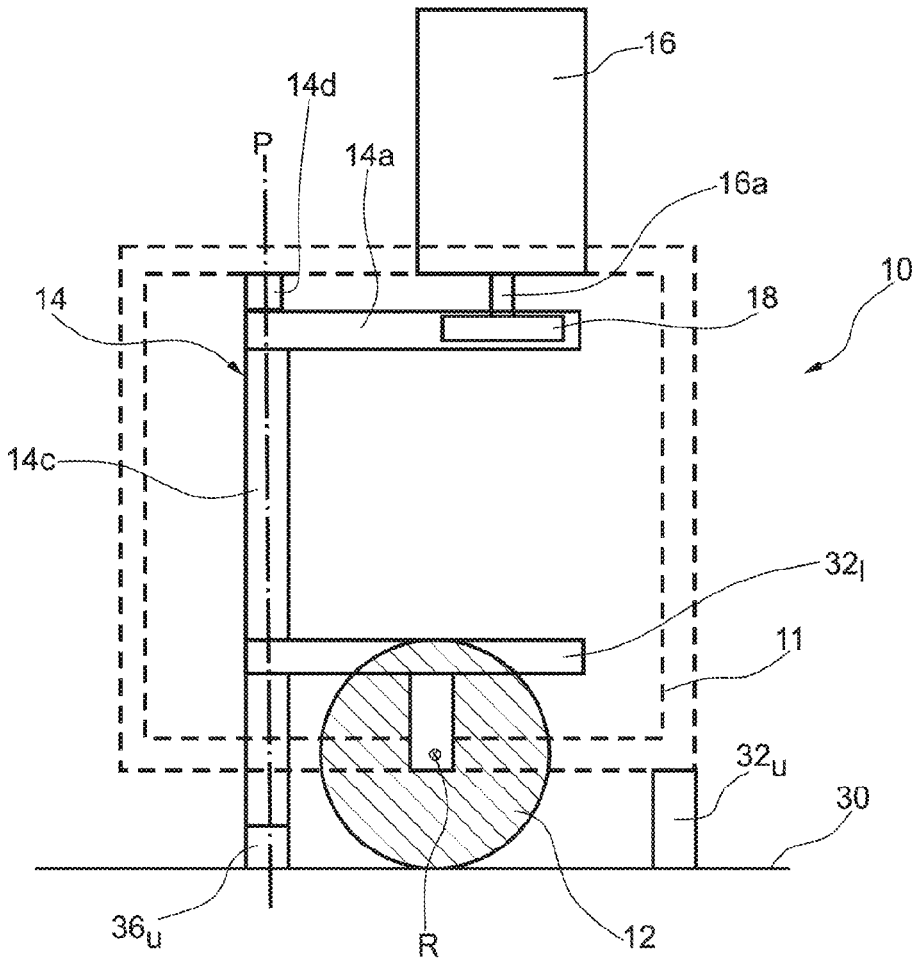
FIG. 3 is a block diagram schematically illustrating an upper part of a cutting device, according to an example, in a side view thereof.
Figure 3A:
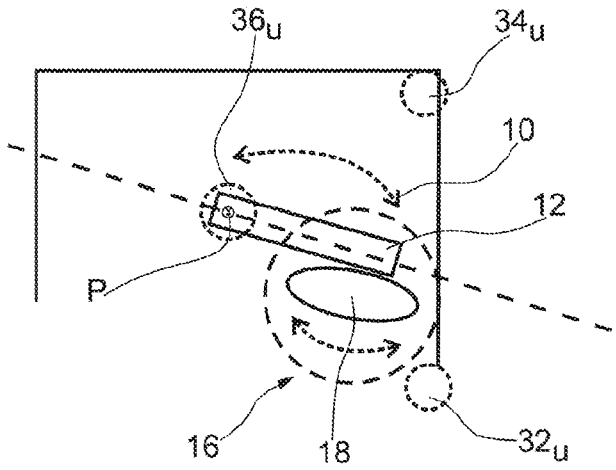
FIG. 3A is a block diagram schematically illustrating the upper part of the cutting device according to FIG. 3, in a top view thereof.

FIGS. 3 and 3A illustrate further details of an upper half of the cutting device including the upper support 10, according to an example. The upper support 10 may comprise an upper frame 11 schematically illustrated as a box which can be attached to the carriage 40. The upper frame 11 supports an upper cutting blade 12 which can rotate around the first axis R, parallel to the media plane 30, and which can be pivoted around a second axis P, perpendicular to the media plane 30. In the example, the upper cutting blade 12 is a circular rotary blade. The rotational movement of the upper cutting blade 12 around the first axis R is caused by a movement of the upper support 10 relative to the medium in the media plane when the cutting blade 12 contacts the medium and roles on the surface of the medium. The pivoting movement of the upper cutting blade 12 around the second axis P is caused by a pivoting bracket 14 coupling the upper cutting blade 12 to a rotary actuator 16, with a cam mechanism 18 between the rotary actuator 16 and the pivoting bracket 14. The upper cutting blade is pivoted to align the upper cutting blade to a cutting direction relative to the medium in the media plane 30.

The rotary actuator 16 may comprise an electric motor, such as a BLDC (brushless direct-current) motor or a servomotor, which may be connected to the upper frame 11. An output shaft 16' of the rotary actuator may be coupled with the cam mechanism 18, the cam mechanism 18 comprising a cam lobe which contacts an arm 14*a* of the pivoting bracket 14. Rotation of the output shaft 16*a* is transferred to the cam lobe which pivots the pivoting bracket 14 and hence the upper cutting blade 12 around the second axis P. The pivoting bracket 14, in this example, is U-shaped with upper and lower horizontal arms 14*a*, 14*b* connected by a vertical bridge portion 14*c*. The bridge portion 14*c* is linked to the upper frame 11 by a bearing shaft 14*d* collinear with the second axis P. Rotational movement of the cam lobe causes the upper horizontal arm 14*a* to be deflected and hence to pivot wherein the pivoting movement is transferred to a corresponding pivoting movement of the upper cutting blade 12 via the bridge portion 14*c* and the lower horizontal arm 14*b*.

A bearing shaft 14*d* may be connected to the upper frame 11 and may include a spring mechanism, such as an internal or external spring, to pull the pivoting bracket 14 and hence the upper cutting blade 12 upwards and away from the media plane 30. A spring force of the spring mechanism can be overcome by a downwards force applied to the pivoting bracket 14 to push the pivoting bracket 14 and hence the upper cutting blade 12 towards and into contact with a medium to be cut and located in the media plane 30.

In the example, two magnets 32, 34 are arranged at a bottom side of the upper frame 11, facing towards the media plane 30. The magnets 32, 34 may be arranged at two neighboring corners or at two diagonally opposite corners or at any other suitably spaced positions at the bottom side of the upper frame 11. Instead of two magnets 32, 34, one magnet or more than two magnets may be provided at the upper support 10. The magnets 32, 34 may be electromagnets to be activated by a control device. In a variant, the magnets may be permanent magnets that can be shifted in the vertical direction to move the magnets towards the media plane 30 and away from the media plane 30.

Further, in the example, an additional magnet 36 is arranged at a bottom side of the pivoting bracket 14, at a position collinear with the second axis P. The additional magnet 36 may be an electromagnet to be activated by the control device. In a variant, the magnet may be a permanent magnet that can be shifted in the vertical direction to move the magnet towards the media plane 30 and away from the media plane 30.

Figure 4:
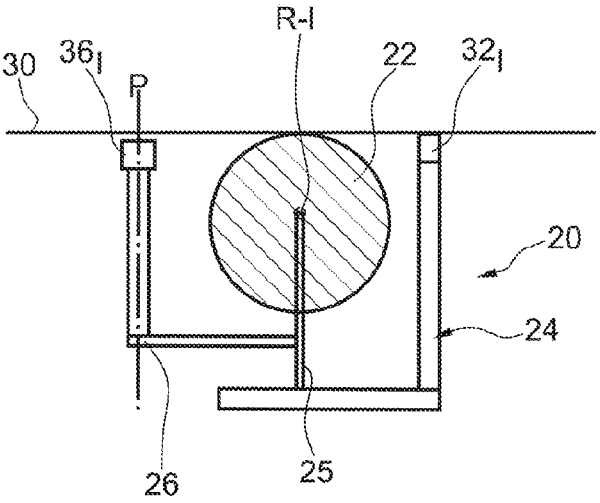
FIG. 4 is a block diagram schematically illustrating a lower part of a cutting device, according to an example, in a side view thereof.
Figure 4A:
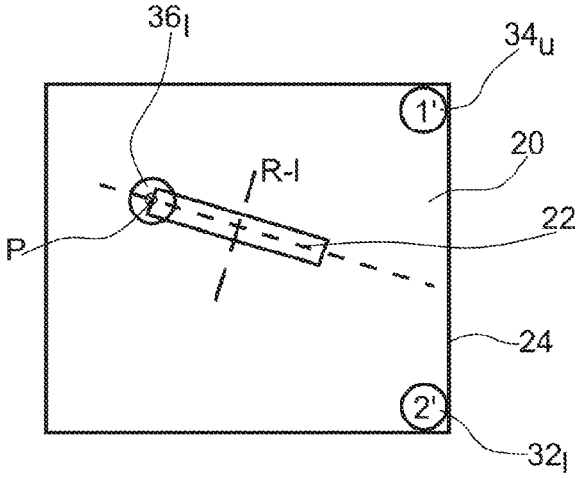
FIG. 4A is a block diagram schematically illustrating the lower part of the cutting device, according to FIG. 4, in a top view thereof.

FIGS. 4 and 4A illustrate further details of a lower half of the cutting device including the lower support 20, according to an example. The lower support 20 includes a lower frame 24 not fixedly attached to the cutting device or an associated printer carriage or the like and which, when not in use, can be stored in a base station. The lower frame 24 of this example supports a lower cutting blade 22 which can rotate around a second rotation axis R_l, parallel to the media plane 30, and which can be pivoted around the pivoting axis P, perpendicular to the media plane 30. In the example, the lower cutting blade 22 also is a circular rotary blade.

Two ferromagnetic bodies 32*l*, 34*l* are arranged at a top side of the lower support 20, more specifically the lower frame 24 thereof, facing towards the media plane 30. The ferromagnetic bodies 32*l*, 34*l* may be arranged at two neighboring corners or at two diagonally opposite corners of the lower frame 24 or at any other positions corresponding to the position of the magnets 32*u* and 34*u* provided at the upper frame 11. Instead of two ferromagnetic bodies 32*l*, 34*l*, one ferromagnetic body or more than two ferromagnetic bodies may be provided also at the lower support 20. The ferromagnetic bodies 32*l*, 34*l* may be permanent magnets or may comprise non-magnetized ferromagnetic material which interacts with the magnets 32*u*, 34*u* provided at the upper support 10. When the magnets 32*u*, 34*u* at the upper support 10 are activated or are shifted in the vertical direction to move towards the media plane 30, they will engage with the ferromagnetic bodies 32*l*, 34*l* at the lower support 20 and pull the lower support 20 towards the upper support 10, with the medium 50 there between.

The cutting blade 22 is coupled with the lower frame 24 by pivoting shaft 25 which in turn is coupled with a pivoting arm 26. The pivoting shaft 25 allows aligning the lower cutting blade 22 to a cutting direction relative to the medium in the media plane 30. The pivoting arm assists in transferring the pivoting movement of the upper cutting blade 12 to the lower cutting blade 22.

To this end, in the example, an additional ferromagnetic body 36*l* is arranged at a top side of the pivoting arm 26, at a position collinear with the second axis P when the upper and lower supports 10, 10 are engaged. The ferromagnetic body 36*l* may be a permanent magnet or may comprise non-magnetized ferromagnetic material which interacts with the magnets 36*u* provided at the upper support 10. When the magnet 36*u* at the upper support 10 is activated or is shifted in the vertical direction to move towards the media plane 30, it will engage with the magnet 36*l*, at the lower support 20 and pull the upper cutting blade 12 and the lower cutting blade 22 towards each other, with the medium 50 there between.

The magnet pairs transmit the translational movement of the upper support 10 to the lower support 20 and the pivoting movement of the upper cutting blade 12 to the lower cutting blade 20. Further details of the upper and lower frames 11, 24 and associated mechanics are described below.

The magnet pairs 32*u*, 32*l*, 34*u*, 34*l*, and 36*u*, 36*l* can be part of a contact-free coupling device and can interact to pull the upper frame 11 and the lower frame 24 towards each other and to pull the upper cutting blade 12 and the lower cutting blade 22 towards each other. With the cutting blades 12, 22 are engaged, the magnet pairs can make the lower frame 24 follow the movement of the upper frame 11 and make the lower cutting blade 20 to follow the movement of the upper cutting blade 12.

In order to allow the respective facing surfaces of the magnet pairs to smoothly slide over the surface of the medium 50 with a minimum of resistance, the facing surfaces of the magnet pairs may be coated with a low resistance materials, such as Polytetrafluorethylen (PTFE, also known as Teflon).

Figure 5:
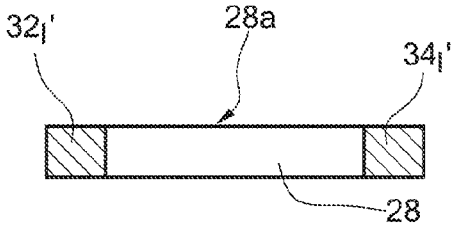
FIG. 5 is a block diagram schematically illustrating a lower part of a cutting device, according to another example, in a side view thereof FIG. 6 schematically shows a perspective view of a cutting device according to an example, as seen from above.

FIG. 5 shows an alternative to the lower support 20 according to another example, not including a cutting blade, but providing a lower support frame 28 having a support surface or counter surface 28*a* which can be engaged with the upper cutting blade 12. Lower magnets or ferromagnetic bodies 321', 341' can be attached to or integrated with the lower support frame 28. The lower magnets or ferromagnetic bodies 321', 341' can be paired with the upper magnets 32*u*, 34*u* in the upper support 10 to pull and hold the lower support frame 28 with its support surface 28*a* against the upper frame 11, for cutting the medium between the support surface 28*a* and the upper cutting blade 12. The upper cutting blade can be designed and controlled as explained with respect to FIGS. 3, 3A.

In a variant, the rotary actuator could be omitted and the upper cutting blade and the lower cutting blade, if any, could respectively be connected to the upper and lower frames 11, 24 via pivoting shafts, similar to pivoting shaft 25, which allow a self adjusting pivoting movement of the cutting blades to follow a cutting direction relative to the medium located in the media plane 30.

Figure 6:
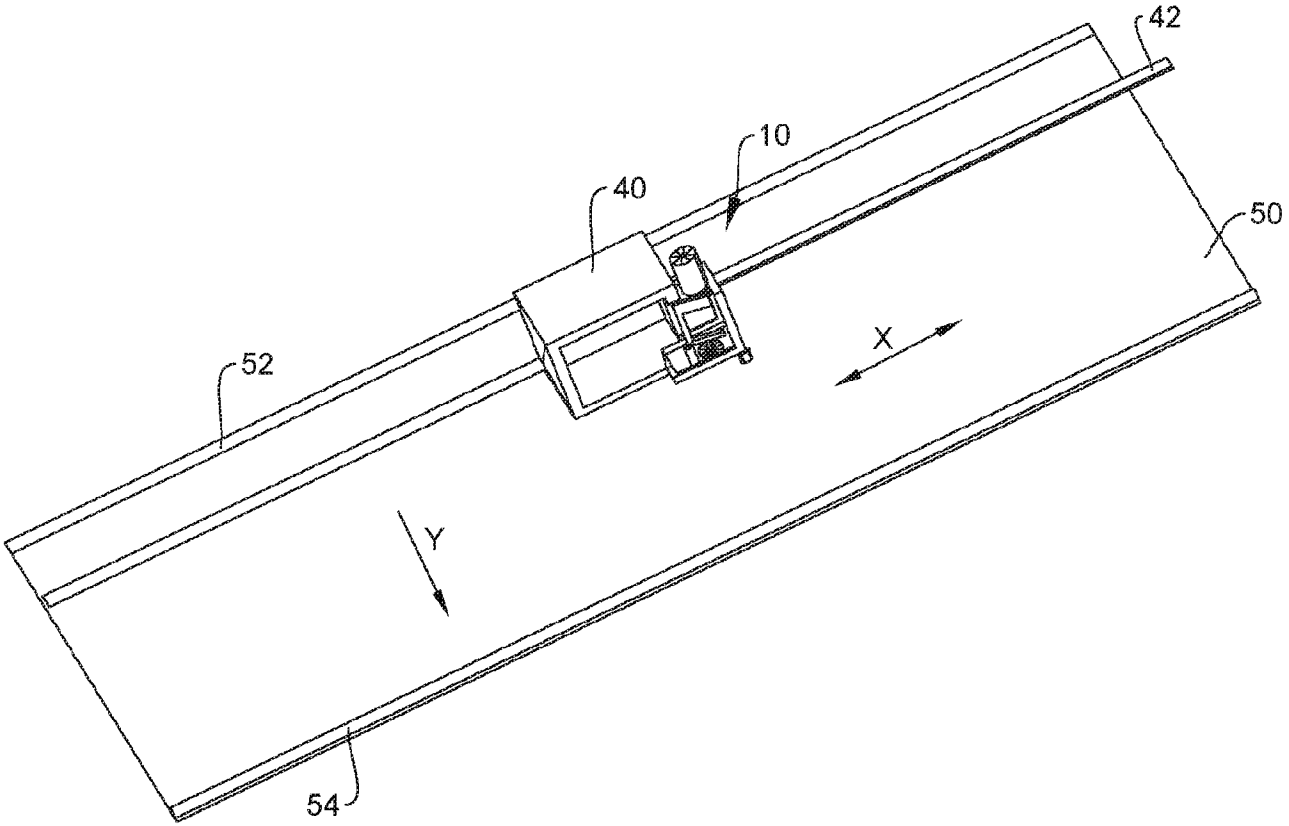
Figure 7:
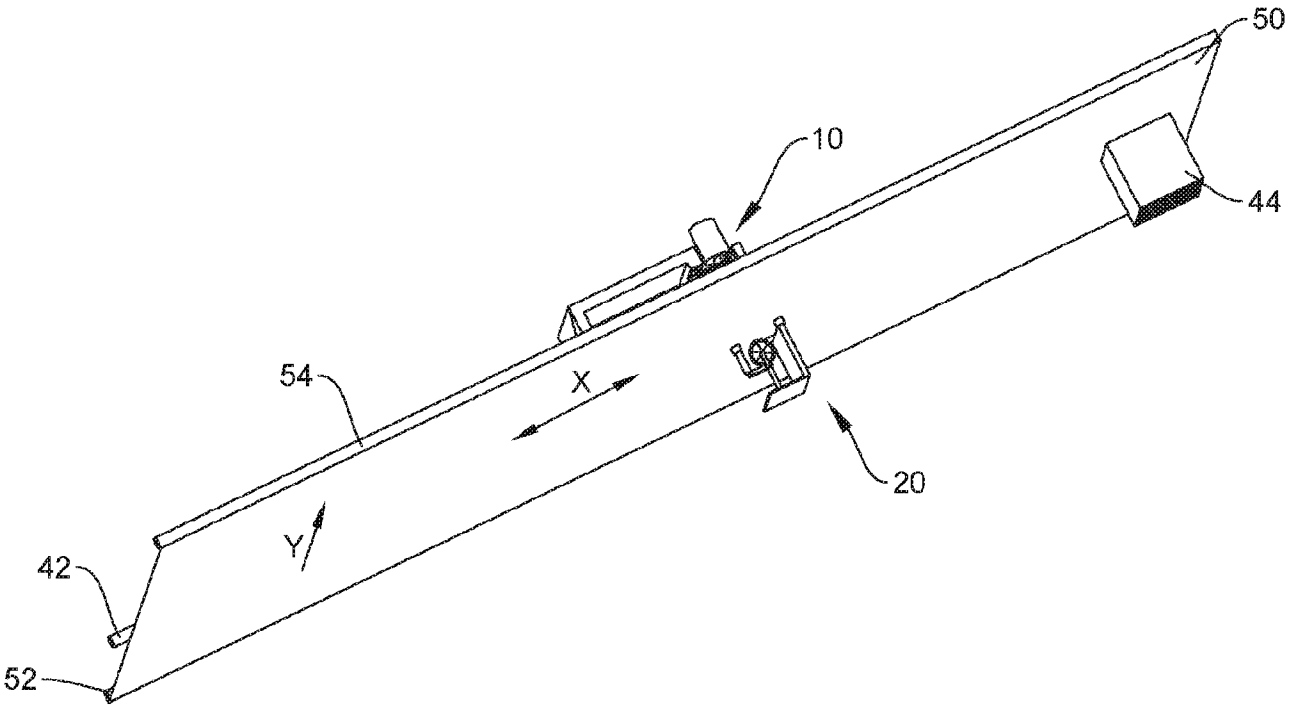
FIG. 7 schematically shows a perspective view of a cutting device according to an example, as seen from below.

FIGS. 6 and 7 schematically show perspective views of a cutting device according to an example, as seen from above and below.

FIG. 6 schematically shows an upper half of the cutting device including the upper support 10 attached to the carriage 40 which is movable along the slide bar 42, in the scanning direction, X. FIG. 7 schematically shows a lower half of the cutting device including the lower support 20 and a base station 44 at the side of and below a cutting zone. FIGS. 6 and 7 further show a medium 50 which extends between the upper and lower halves of the cutting device and which, in the example shown, is a continuous web of a print medium which is fed in the media advance direction, Y, from an input roller 52 to an output 54, below carriage 40. The medium 50 may be tightened or biased between the input roller 52 and the output roller 54, e.g. by rotating the output roller at a speed slightly higher than the speed of the input roller, so as to provide a smooth cutting surface below the carriage 40. Instead of a continuous web, the medium also may be as a single sheet of medium that is fed from an input tray or a drawer, or a roll of paper, for example. The medium may be from paper, carton, textile or foil, for example.

Whereas not shown in the drawings, the carriage 40 may be a printer carriage additionally carrying at least one print head, e.g. four, MCYK, ink inkjet print heads. A printing fluid may be dispensed from the print heads which may be any fluid that can be dispensed by an inkjet-type printer or other inkjet-type dispenser and may include inks, varnishes, and/or post or pre-treatment agents, for example.

A print zone and/or cutting zone may be defined in the entire area or part of the area which can be traversed by the carriage 40. In the views of FIGS. 6 and 7, the width of the print zone and/or cutting zone may correspond to the width of the medium 50 in the X direction. The base station 44 can be located at the side of the cutting zone at such a position where it is overlapped by the medium 50. The lower half of the cutting device, including the lower support 20 can be located either in or at the base station 44 or at a position where it is aligned with the upper half of the cutting device, including the upper support 10, as explained above.

Figure 8:
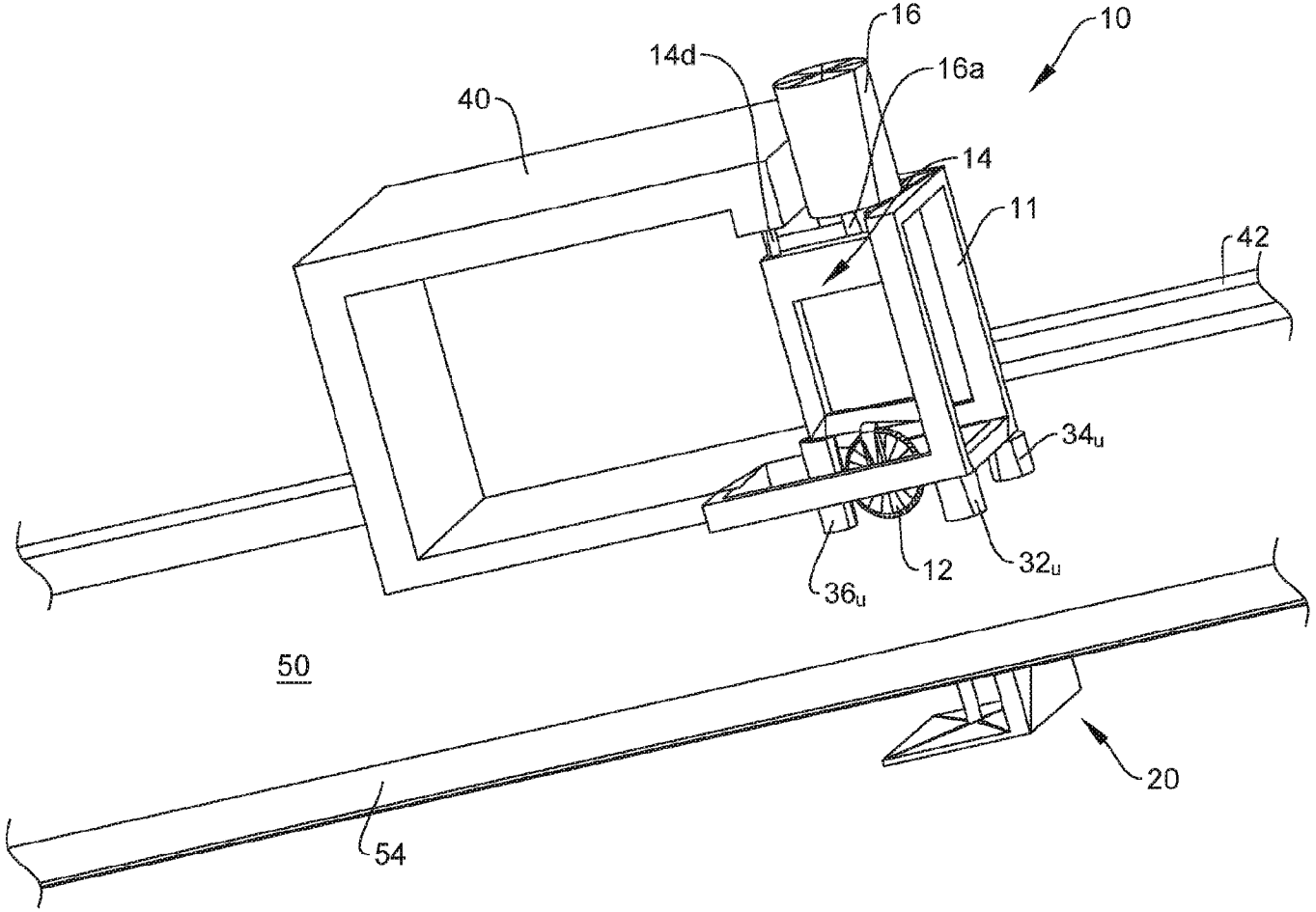
FIG. 8 schematically shows another perspective view of a cutting device according to an example, as seen from above.
Figure 9:
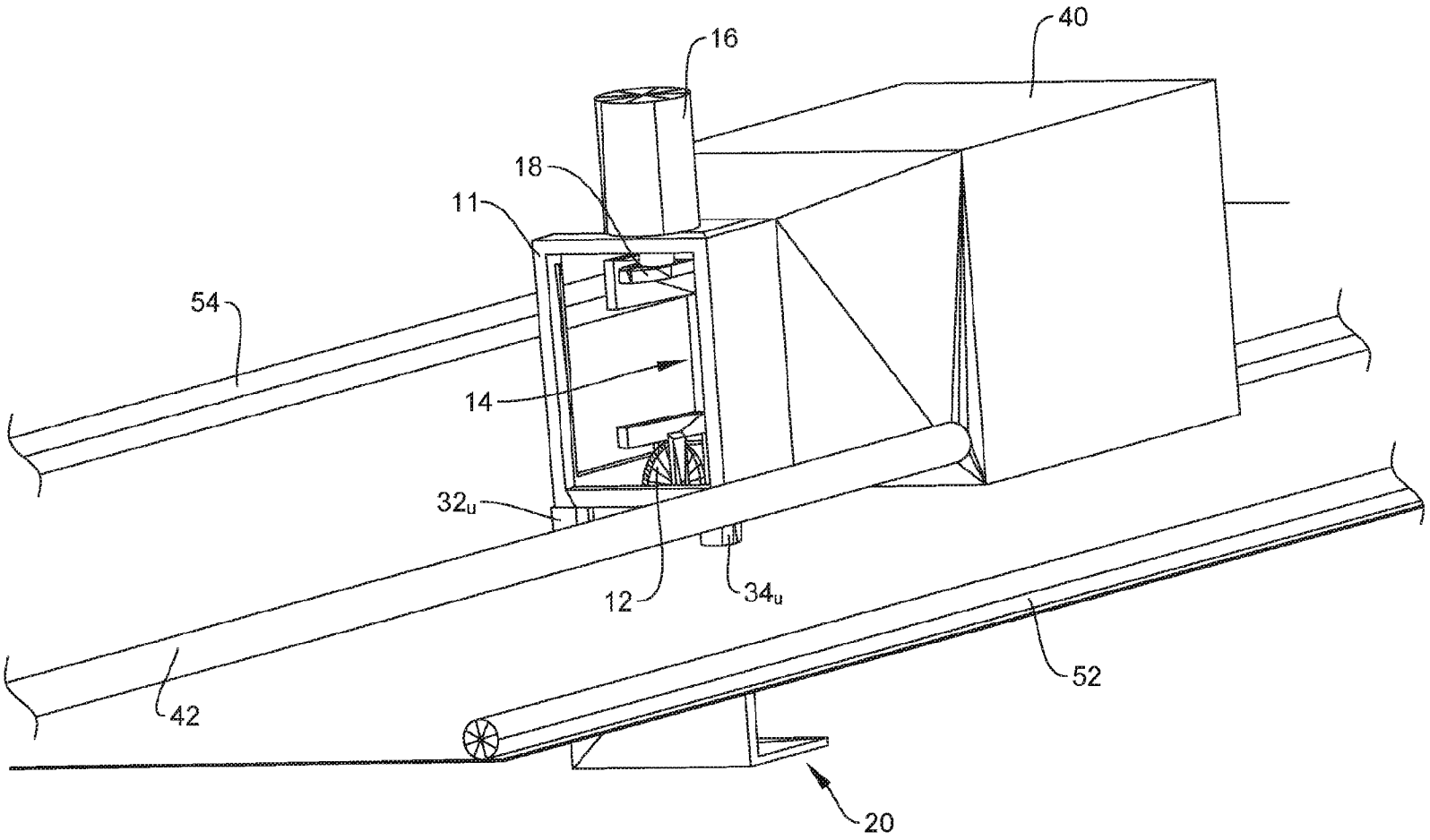
FIG. 9 schematically shows still another perspective view of a cutting device according to an example, as seen from above.

FIGS. 8 and 9 schematically show the upper half of the cutting device according to an example, in further detail. The same reference numbers are used to designate the same or corresponding features as referenced above with respect to FIGS. 3 and 3A. The figures illustrate the upper frame 11 which is attached to the carriage 40 and supports the rotary actuator 16 and the pivoting bracket 14. In the example of FIGS. 8 and 9, the pivoting bracket 14 is shown to be attached to a side of the carriage 40, via the bearing shaft 14*d*, but it could as well be attached to the upper frame 11. In this regard, the sidewall of the carriage 40 may be considered to be part of the upper frame 11. FIG. 9 illustrates how rotational movement of the rotary actuator 16 is transferred to pivoting bracket 14 via cam lobe 18, to pivot and direct cutting blade 12. Accordingly, if the carriage 40 moves along slide bar 42 in the printing direction, X, the cutting blade 12 roles across the surface of the medium 50 to cut the medium 50. If additionally, the medium is moved below the carriage in the media advance direction, Y, the cutting blade can cut virtually any arbitrary shapes. To provide a smooth cutting line, the cutting blade 12 can be pivoted via the rotary actuator 16 and the pivoting bracket 14 to be directed in a desired cutting direction.

FIG. 8 further illustrates the upper magnets 32*u*, 34*u*, 36*u*, attached to the bottom sides of the upper frame 11 and the pivoting bracket 14.

Figure 10:
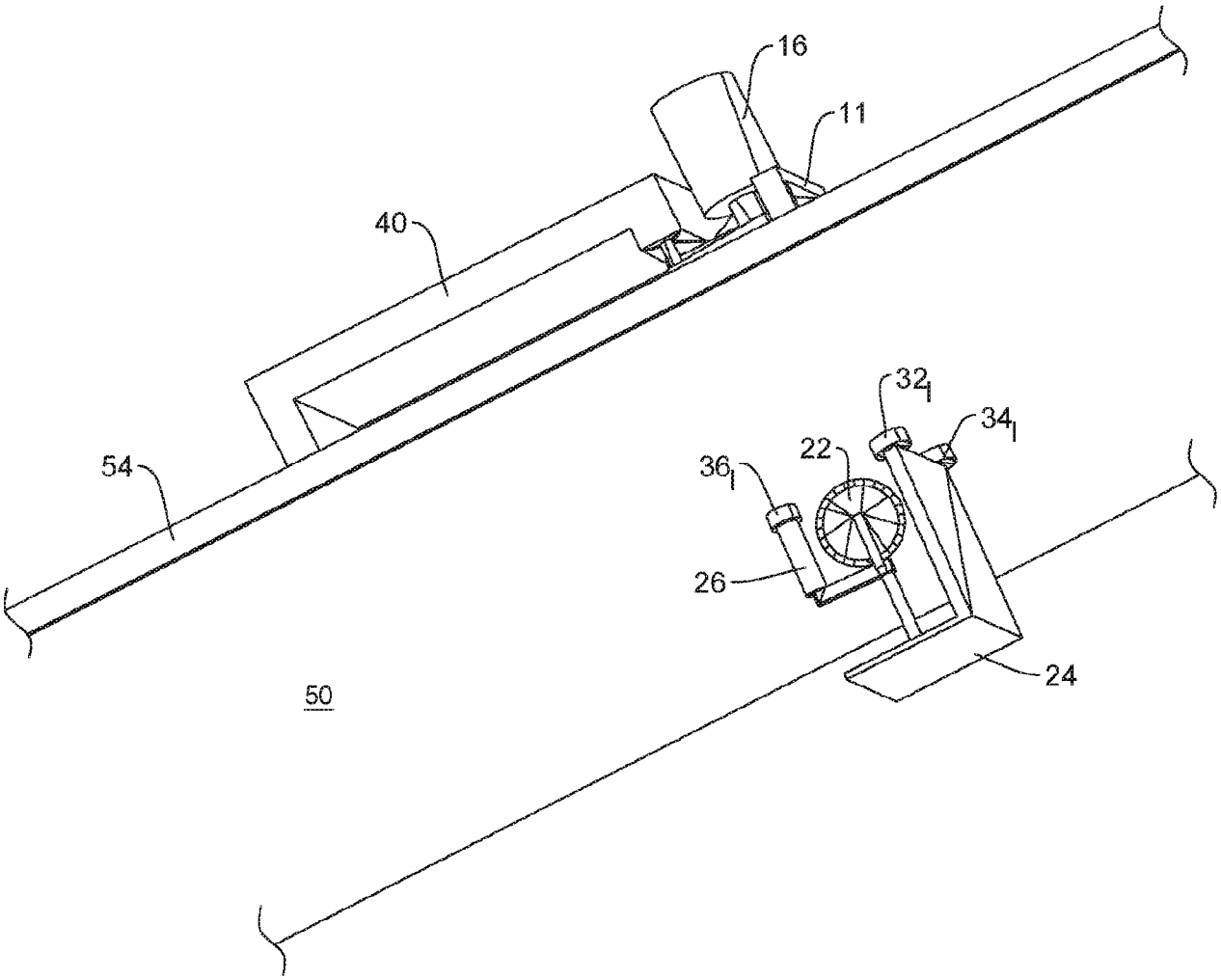
FIG. 10 schematically shows another perspective view of a cutting device according to an example, as seen from below.

FIG. 10 schematically shows the lower half of the cutting device in further detail. The same reference numbers are used to designate the same or corresponding features as referenced above with respect to FIGS. 4 and 4A. The figure illustrates the lower frame 24 which is not fixedly attached to the carriage or another part of the cutting device and/or printer in which may be stored in base station 44. The lower frame 24 supports the lower cutting blade 22 in such a way that it can be pivoted by a pivoting arm 26. FIG. 10 further illustrates the lower magnets 32*l*, 34*l*, 36*l*, attached to the bottom sides of the lower frame 24 and the pivoting arm 26.

Figure 11:
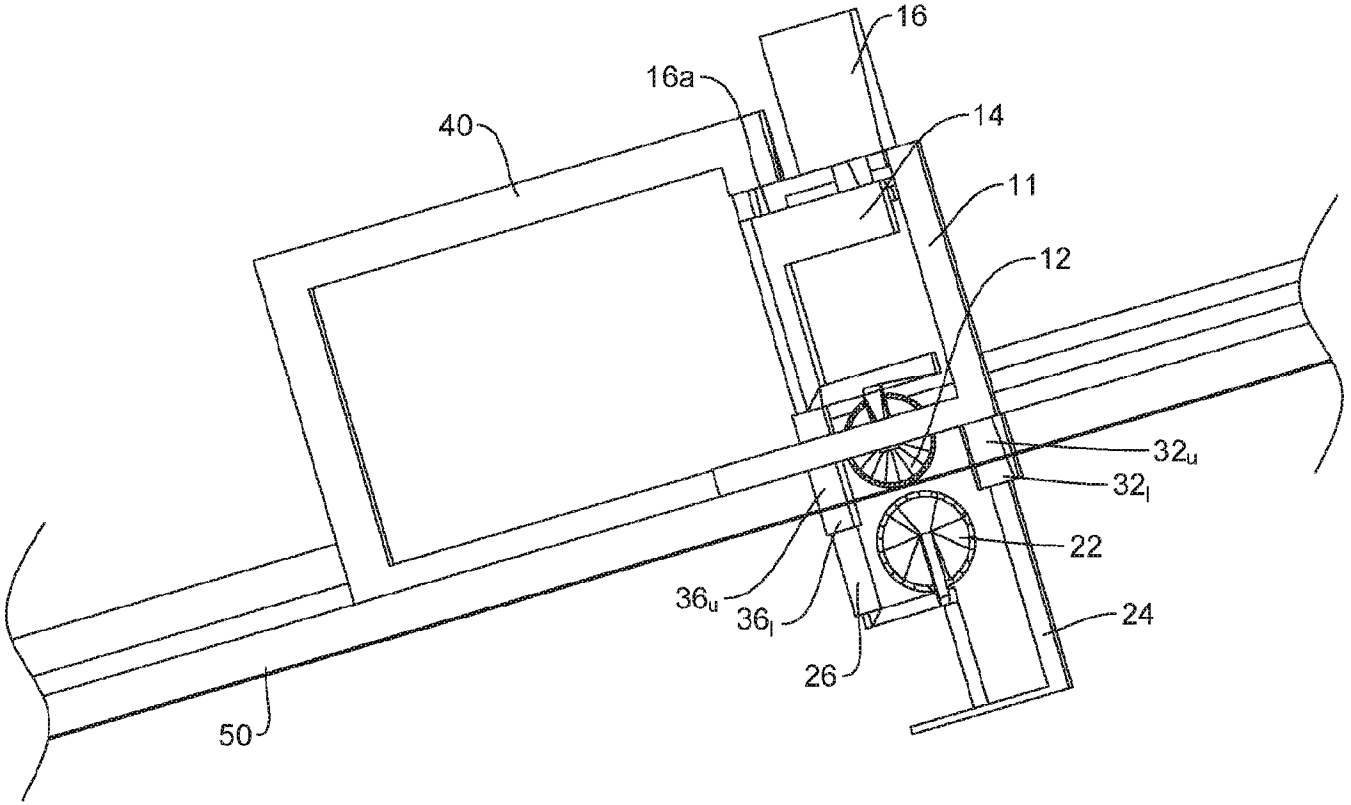
FIG. 11 schematically shows a side view of a cutting device according to an example.

FIG. 11 schematically shows a side view of the cutting device of FIGS. 8 to 10. The same reference numbers are used to designate the same or corresponding features as referenced above and reference is made to the description of these features. For improved clarity, the output roller 54 has been omitted in the drawing. The operation of the cutting device is explained with reference to FIG. 11.

When a cutting operation is to be initiated, the upper half of the cutting device, shown in FIGS. 8 and 9, can be moved to a position above the base station 44 where the lower half of the cutting device is stored, by moving the carriage 40 along the slide bar 42. The upper half of the cutting device can be positioned relative to the lower half of the cutting device, shown in FIG. 10, so that the magnet pairs 32*u*, 32*l* and 34*u*, 34*l* are aligned. In one example, the upper parts 32*u*, 34*u* of the magnet pairs comprise electromagnets and the lower parts 32*l*, 34*l* comprise ferroelectric bodies or counter parts. The electromagnets 32*u*, 34*u* are activated to pull the electric counter parts 32*l* 34*l* up and towards the electromagnets 32*u*, 34*u*. Accordingly, by activating the upper electromagnets 32*u*, 34*u*, the upper frame 11 of the cutting device can engage with the lower frame 24 of the cutting device. At this stage, the upper and lower cutting blades 12, 22 are not engaged but are spaced from the medium 50, e.g. by respective spring mechanisms which may be provided at the bearing shaft 16A and pivoting arm 26. The magnet pair 36*u*, 36*l* is not activated.

At this stage, any movement of the upper half of the cutting device, e.g. by movement of carriage 40, will be translated to a movement of the lower half of the lower cutting device, so that the lower frame 24 follows the movement of the upper frame 11. Accordingly, the upper frame 24 can pull the lower frame 24 to a desired cutting position.

When a desired cutting position has been reached, the magnet pair 36*u*, 36*l* can be activated. For example, if the upper part 36*u* comprises an electromagnet and the lower part 36*l* comprises a ferroelectric body or counter part, the magnet pair 36*u*, 36*l* can be activated by activating the electromagnet 36*u*. Accordingly, the upper and lower cutting blades 12, 22 are pulled towards each other and engage on opposite surfaces of medium 50. At this time, the upper and lower cutting blades 12, 22, can be used for cutting the medium when the cutting device, including the upper and lower frames 12, 24, is moved relative to the medium surface, by movement of the carriage 40 and by movement of the medium 50 in the X and Y directions. Additionally, for providing a clean cutting line, cutting blade 12 can be pivoted via rotary actuator 16 and pivoting bracket 14 to be aligned with the cutting direction, which may be at any angle relative to the X and Y directions. Pivoting movement of upper cutting blade 12 can be transferred to a corresponding pivoting movement of lower cutting blade 22 via the magnet pair 36*u*, 36*l* and pivoting arm 26.

The design of the cutting device described achieves a very high cutting quality and is able to cut all types of different media and materials, including relatively thick media. Because two cutting blades interact, it has a high life span and low wear. Yet it is easy to manufacture because it can operate without a separate drive and fixture for the lower half of the cutting device.

As indicated above, in a variant, the lower half of the cutting device, instead of a lower cutting blade, also may include a support surface or counter surface which can be engaged with the upper cutting blade. Lower magnets or ferromagnetic bodies can be attached to or integrated with the lower support frame. The lower magnets or ferromagnetic bodies can be paired with the upper magnets 32*u*, 34*u* in the upper support 10 to pull and hold the lower support frame with its support surface against the upper frame 11, for cutting the medium between the support surface and the upper cutting blade 12. The upper cutting blade 12 can be lowered onto the medium by a spring mechanism or by magnetic actuation, similar to the mechanism described above.

In a further variant, the rotary actuator could be omitted and the upper cutting blade and the lower cutting blade, if any, could respectively be connected to the upper and lower frames 11, 24 via pivoting shafts, similar to pivoting shaft 25, which allow a self adjusting pivoting movement of the cutting blades to follow a cutting direction relative to the medium located in the media plane 30, as explained above.

The variant can be manufactured using less parts and is less complex in manufacture and control of the cutting movements.

Drive of the carriage 40, medium 50 and rotary actuator 16 may be controlled by a controller (not shown). The controller can be a microcontroller, ASIC, or other control device, including control devices operating based on software, hardware, firmware or a combination thereof. It can include an integrated memory or communicate with an external memory or both. The same controller or separate controllers may be provided for controlling carriage movement, medium advance and the rotary actuator. Different parts of the controller may be located internally or externally to a printer or separate cutting device, in a concentrated or distributed environment.

In the example illustrated, the cutting device has been described to be part of a printer and the upper half of the cutting device has been described to be attached to a printer carriage 40. In a variant, the cutting device can be provided at its own dedicated carriage and/or it can be provided as a stand-alone device or in combination with other types of equipment.

The invention claimed is:

1. A cutting device for cutting media located in a media plane, the cutting device comprising:

an upper support and a lower support arranged above and below the media plane, and a contact-free coupling device to engage and disengage the upper support and the lower support, wherein one of the upper support and the lower support is a master support and the other one of the upper and lower supports is a slave support, and further comprising a master cutting blade arranged in the master support, wherein when the upper and lower supports are engaged, the slave support follows movement of the master support; and wherein the master cutting blade is pivotally mounted so as to pivot around an axis perpendicular to the media plane.

2. The cutting device of claim 1 wherein the coupling device comprises a magnet.

3. The cutting device of claim 1 further comprising a slave cutting blade arranged in the slave support.

4. The cutting device of claim 3 wherein both the master and slave cutting blades are circular rotary blades.

5. The cutting device of claim 1 wherein the coupling device comprises a first controllable electromagnet arranged on the master support and a first ferromagnetic counterpart arranged on the slave support.

6. The cutting device of claim 5 further comprising a cutting device drive system to move the master support across the media plane.

7. The cutting device of claim 6 wherein the coupling device comprises a second controllable electromagnet associated with the master cutting blade and a second ferromagnetic counterpart associated with the slave cutting blade.

8. The cutting device of claim 7 further comprising a controller to control the first controllable electromagnet, the second controllable electromagnet and the drive system, and to activate and deactivate the first controllable electromagnet for engaging and de-engaging the master support and the slave support via the first controllable electromagnet and the ferromagnetic counterpart, and to activate and deactivate the second controllable electromagnet for engaging and de-engaging the master and slave cutting blades via the second controllable electromagnet and the second ferromagnetic counterpart.

9. The cutting device of claim 1 further comprising a rotary actuator arranged on the master support to pivot the master cutting blade around the axis perpendicular to the media plane.

10. The cutting device of claim 9 wherein the rotary actuator comprises an electric motor having an output shaft connected to rotate a cam lobe which pivots a bracket supporting the master cutting blade around the axis perpendicular to the media plane.

11. The cutting device of claim 1 wherein the slave support is held against a surface of a media located in the media plane and is moved across the media plane by the master support.

12. The cutting device of claim 11 wherein the master support is an upper support and is associated with a drive system for moving the upper support across an upper surface of media located in the media plane and the slave support is a lower support which, when engaged with the upper support, moves across a lower surface of the media located in the media plane.

13. The cutting device of claim 1 wherein the master cutting blade comprises a rotary blade.

14. The cutting device of claim 1 further comprising a spring to bias the master cutting blade away from the media plane, the bias being overcome to engage the master cutting blade when cutting a medium in the media plane.

15. The cutting device of claim 1 wherein the lower support comprises a counter surface to engage with the master cutting blade.

16. A printer comprising:

a print head carriage and a drive system to move the print head carriage across a print zone, an upper cutting blade support attached to the print head carriage above the print zone;

an upper cutting blade arranged in the upper cutting blade support above the print zone;

a lower cutting blade support arranged below the print zone;

a lower cutting blade arranged in the lower cutting blade support below the print zone;

a first contact-free coupling device comprising a first electromagnet arranged in the upper cutting blade support and a first ferroelectric counterpart arranged in the lower cutting blade support;

the first contact-free coupling device to engage the upper and lower cutting blade supports by activating the first electromagnet, wherein, when engaged, the lower cutting blade support follows a movement of the upper cutting blade support and, when disengaged, the lower cutting blade support remains at a given position irrespective of a movement of the upper cutting blade support.

17. The printer of claim 16 further including a base station of the lower cutting blade support which is arranged at a side of the print zone, with the drive system to also move the print head carriage to the base station and position the upper cutting blade support above the base station so that, when the upper cutting blade support is above the base station, the lower cutting blade support is in the base station and the first electromagnet is activated, the upper cutting blade support engages with the lower cutting blade support.

18. The printer of claim 16 further including a second contact-free coupling device comprising a second electromagnet associated with the upper cutting blade and a second ferroelectric counterpart associated with the lower cutting blade;

the second contact-free coupling device to engage the upper and lower cutting blades by activating the second electromagnet; and further including a rotary actuator associated with the upper cutting blade to pivot the upper cutting blade around an axis perpendicular to the print zone; and a coupling part to transfer pivoting movement of the upper cutting blade to the lower cut-ting blade via the second contact-free coupling device.

19. A method of cutting media using an upper cutting blade arranged in an upper support and a lower cutting blade or a lower support surface arranged in a lower support, above and below a media cutting plane, the method comprising:

moving the upper support to a pick-up position where the lower support is stored, engaging the upper and lower supports, wherein the lower support is supported only by contact-free coupling with the upper support;

moving the upper support to a cutting position, with the lower support following the movement of the upper support;

engaging the upper cutting blade and the lower cutting blade or lower support surface;

moving the upper support across the media cutting plane, with the lower support following the movement of the upper support and upper cutting blade so that the media is cut between the upper cutting blade and the lower cutting blade or lower support surface.

20. The method of claim 19 further comprising engaging the upper and lower supports by activating an electromagnet, the magnetic field of which provides the contact-free coupling between the upper and lower supports.

* * * * *